US008807463B1

(12) United States Patent
McAlister

(10) Patent No.: US 8,807,463 B1
(45) Date of Patent: Aug. 19, 2014

(54) FUEL INJECTOR WITH KINETIC ENERGY TRANSFER ARMATURE

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 13/830,575

(22) Filed: Mar. 14, 2013

(51) Int. Cl.
*B05B 1/30* (2006.01)
*F02M 51/00* (2006.01)
*F02M 51/06* (2006.01)

(52) U.S. Cl.
CPC ..... *F02M 51/066* (2013.01); *F02M 51/061* (2013.01); *F02M 51/0614* (2013.01); *F02M 51/0692* (2013.01)
USPC ..... 239/585.2; 239/584; 239/585.1; 239/585.3

(58) Field of Classification Search
CPC ..... F02M 51/061; F02M 51/0614; F02M 51/066; F02M 51/0692
USPC ..... 239/569, 583, 584, 585.1, 585.2, 585.3, 239/585.4
See application file for complete search history.

(56) References Cited

U.S. PATENT DOCUMENTS

| | | | | |
|---|---|---|---|---|
| 5,868,108 | A * | 2/1999 | Schmitz et al. | 123/90.11 |
| 6,065,684 | A * | 5/2000 | Varble et al. | 239/5 |
| 6,184,767 | B1 * | 2/2001 | Pischinger et al. | 335/256 |
| 7,146,943 | B2 * | 12/2006 | Sedda et al. | 123/90.11 |
| 7,533,834 | B2 * | 5/2009 | Grundl et al. | 239/585.5 |
| 2003/0116657 | A1 * | 6/2003 | Nakayama et al. | 239/585.1 |

* cited by examiner

*Primary Examiner* — Ryan Reis
(74) *Attorney, Agent, or Firm* — Perkins Coie LLP

(57) ABSTRACT

Injectors and solenoid valves incorporating actuators with kinetic energy transfer armatures. A fuel injector includes a longitudinally extending injector body and a valve supported in the injector body. The valve is configured for longitudinal movement within the injector body. An armature is connected to the valve and an impact member is disposed between the armature and a solenoid, and moveably connected to the armature. The solenoid is operative when energized to sequentially move the impact member and armature toward the solenoid, thereby actuating the valve. The fuel injector further includes a return magnet located adjacent the armature and opposite the solenoid, wherein the return magnet is operative to maintain the valve in a closed position when the solenoid is not energized.

20 Claims, 8 Drawing Sheets

FUEL INJECTOR WITH KINETIC ENERGY TRANSFER ARMATURE

BACKGROUND

Providing fuel into the combustion chamber of an engine during operation must occur in an extremely small amount of time. As engine speed increases the amount of time for fuel injection decreases. In engines operating on gaseous fuels, a relatively large volume of fuel is needed in this short amount of time. Thus, fuel injectors with high speed actuation capabilities are desirable in order to provide engines with enough fuel in a short amount of time. Furthermore, in some applications, multiple pilot injections of fuel are desirable for power and emissions optimization. Thus, fuel injectors with high speed actuation capabilities are also desirable in order to provide multiple injections in a short amount of time. Accordingly, there is a need for an actuator that can open and close a valve quickly. There is a further need for a fuel injector that can open and close quickly.

BRIEF DESCRIPTION OF THE DRAWINGS

Non-limiting and non-exhaustive embodiments of the devices, systems, and methods, including the preferred embodiment, are described with reference to the following figures, wherein like reference numerals refer to like parts throughout the various view unless otherwise specified.

DETAILED DESCRIPTION

Figure 1:
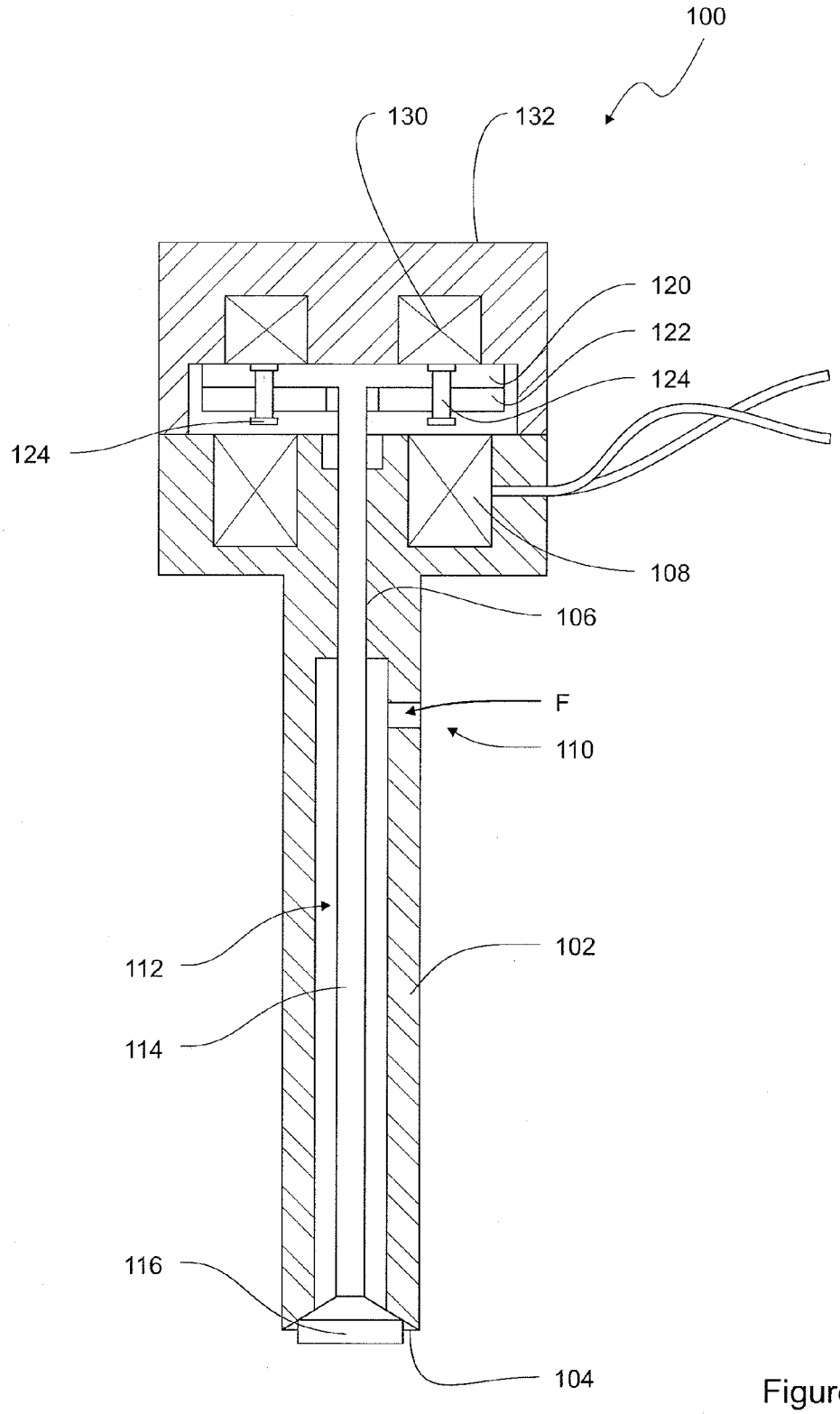
FIG. 1 is a schematic partial cross-sectional side view of an injector according to a representative embodiment incorporating a kinetic energy transfer armature.

Provided herein are injectors and valve drivers such as piezoelectric, magnetostrictive, hydraulic, pneumatic and electromagnetic solenoid valves incorporating actuators with kinetic energy transfer armatures. The representative embodiments disclosed herein, include a solenoid that is operative to sequentially move an impact member and armature toward the solenoid thereby actuating the valve. Thus, the transfer of kinetic energy from the impact member to the armature provides a slide-hammer kinetic energy transfer effect that quickly opens the valve. In a representative embodiment, a fuel injector includes a longitudinally extending injector body and a valve supported in the injector body. The valve is configured for longitudinal movement within the injector body. An armature is connected to the valve and an impact member is disposed between the armature and a solenoid, and moveably connected to the armature. The solenoid is operative when energized to sequentially move the impact member and armature toward the solenoid, thereby actuating the valve.

In one aspect of the present technology disclosed herein, the armature and impact member may be disk shaped. In another aspect of the present technology, the impact member and armature are connected together by a plurality of fasteners, such as rivets or threaded fasteners. In a further aspect of the technology, the valve opens outward from the injector body.

In some embodiments, the fuel injector further includes a return magnet located adjacent the armature and opposite the solenoid, wherein the return magnet is operative to maintain the valve in a closed position when the solenoid is not energized. In various aspects of the technology the return magnet may be an electromagnet or a permanent magnet, for example.

In a representative embodiment, a solenoid valve comprises a valve body and a valve supported in the valve body. The valve is configured for linear movement in the valve body. An armature is connected to the valve and an impact member is disposed between the armature and a solenoid, and moveably connected to the armature. The solenoid is operative when energized to sequentially move the impact member and armature toward the solenoid, thereby actuating the valve.

Also disclosed herein are methods of actuating injectors and valves. In a representative embodiment, the method includes holding a valve in a closed position, accelerating an impact member relative to an armature connected to the valve, thereby imparting kinetic energy to the impact member, and transferring at least a portion of the kinetic energy from the impact member to the armature, thereby causing the valve to quickly move to an open position. In certain aspects of the disclosed technology, holding the valve in the closed position is accomplished with a magnet. In other aspects of the technology, accelerating the impact member relative to the armature is accomplished with a solenoid, wherein the solenoid is operative when energized to sequentially move the impact member and armature toward the solenoid, thereby actuating the valve.

Specific details of several embodiments of the technology are described below with reference to FIGS. 1-8. Other details describing well-known structures and systems often associated with fuel systems and electronic valve actuation have not been set forth in the following disclosure to avoid unnecessarily obscuring the description of the various embodiments of the technology. Many of the details, dimensions, angles, and other features shown in the figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-8.

FIG. 1 is a schematic diagram of a fuel injector 100 according to a representative embodiment. Fuel injector 100 includes a longitudinally extending injector body 102 with a valve 112 supported in the injector body 102 and configured for longitudinal linear movement within the injector body 102. Valve 112 includes a valve stem 114 with a valve head 116 disposed thereon. Valve head 116 seals against valve seat 104. Valve stem 114 may be supported in injector body 102 along a bearing region 106, for example. Fuel F is provided through port 110 and is injected through an opening between the valve head 116 and valve seat 104 when actuated.

Injector 100 includes a suitable selection of actuator such as an electromagnetic solenoid 108 that is operative when energized to open valve 112 relative to seat 104. An armature 120 is connected to valve stem 114 and an impact member 122 is disposed between the armature 120 and solenoid 108 and is movably connected to the armature 120 with a plurality of fasteners 124. Fasteners 124 may be any suitable fasteners such as cooperative threaded fasteners, pins, or rivets. In this embodiment both the armature 120 and impact member 122 are disc shaped components, however, the armature and impact member may have suitable configurations other than those shown in the figures.

FIG. 1 illustrates injector 100 in a closed position. Return magnet 130, such as an electromagnet or permanent magnet, is located adjacent the armature 120 and opposite the solenoid 108. Return magnet 130 is operative to maintain the valve 112 in a closed position when the solenoid 108 is not energized. Injector 100 includes an end cap 132 which houses the return magnet 130 and in some embodiments contains the armature and impact member. Return magnet 130 may be a permanent magnet, or in some instances may be an electromagnet or a combination of permanent and electromagnetic components. Although shown in this embodiment as being a ring magnet, return magnet 130 may be one or more selections of disks, bars, or other suitable configurations.

Figure 2:
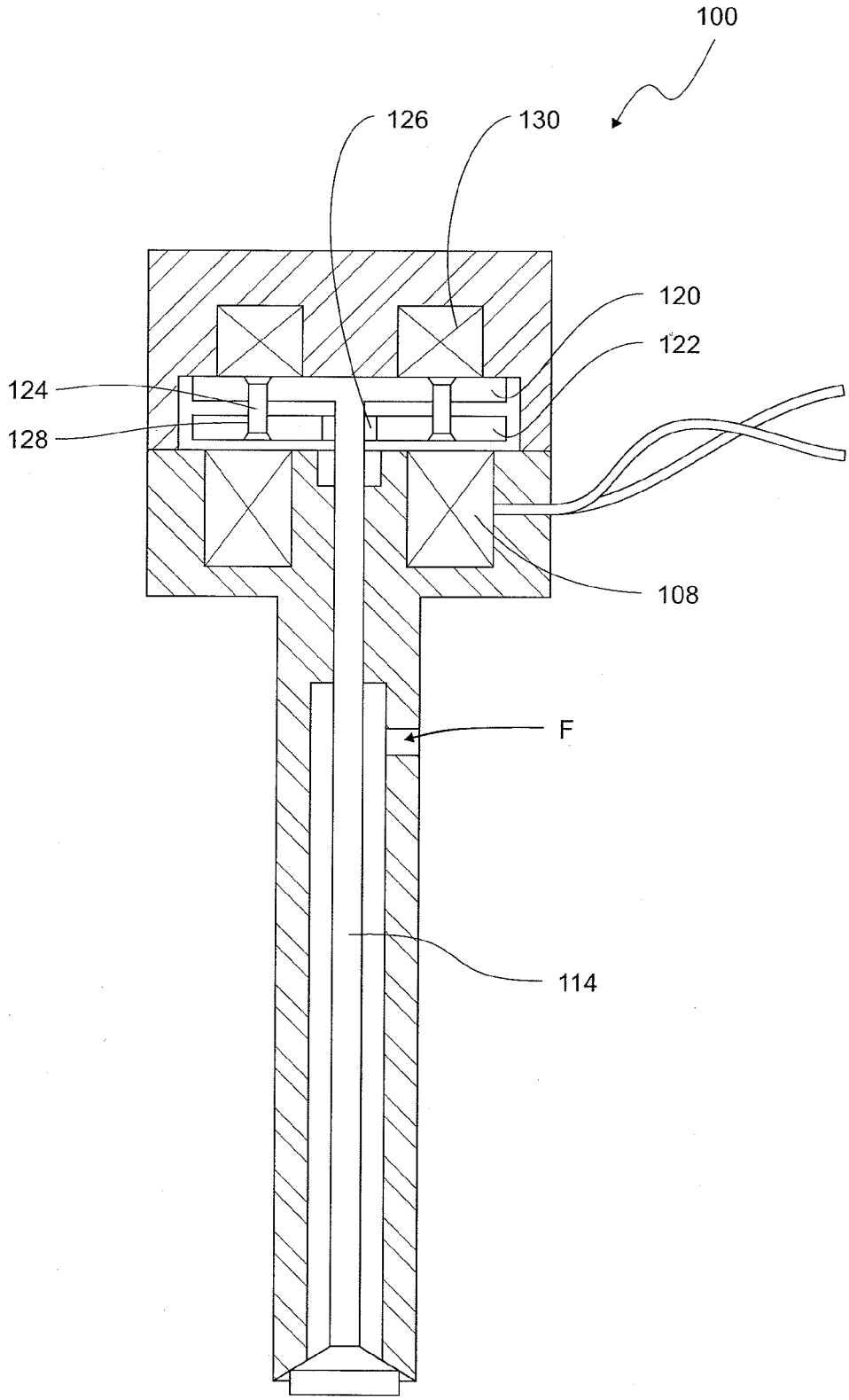
FIG. 2 is a schematic partial cross-sectional side view of the injector shown in FIG. 1 during initial valve actuation.
Figure 3:
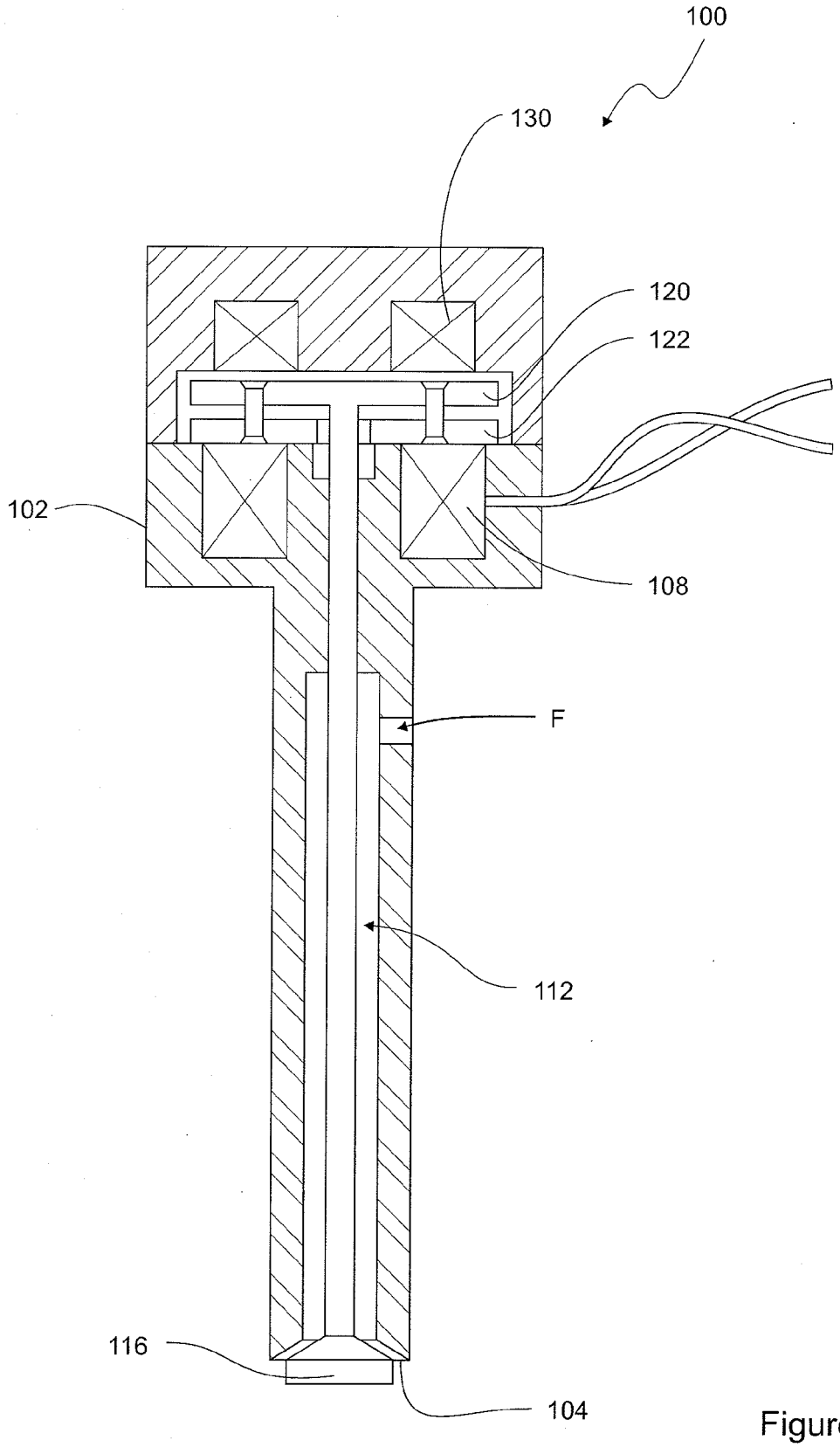
FIG. 3 is a schematic partial cross-sectional side view of the injector shown in FIG. 1 during valve actuation with the valve partially opened.
Figure 4:
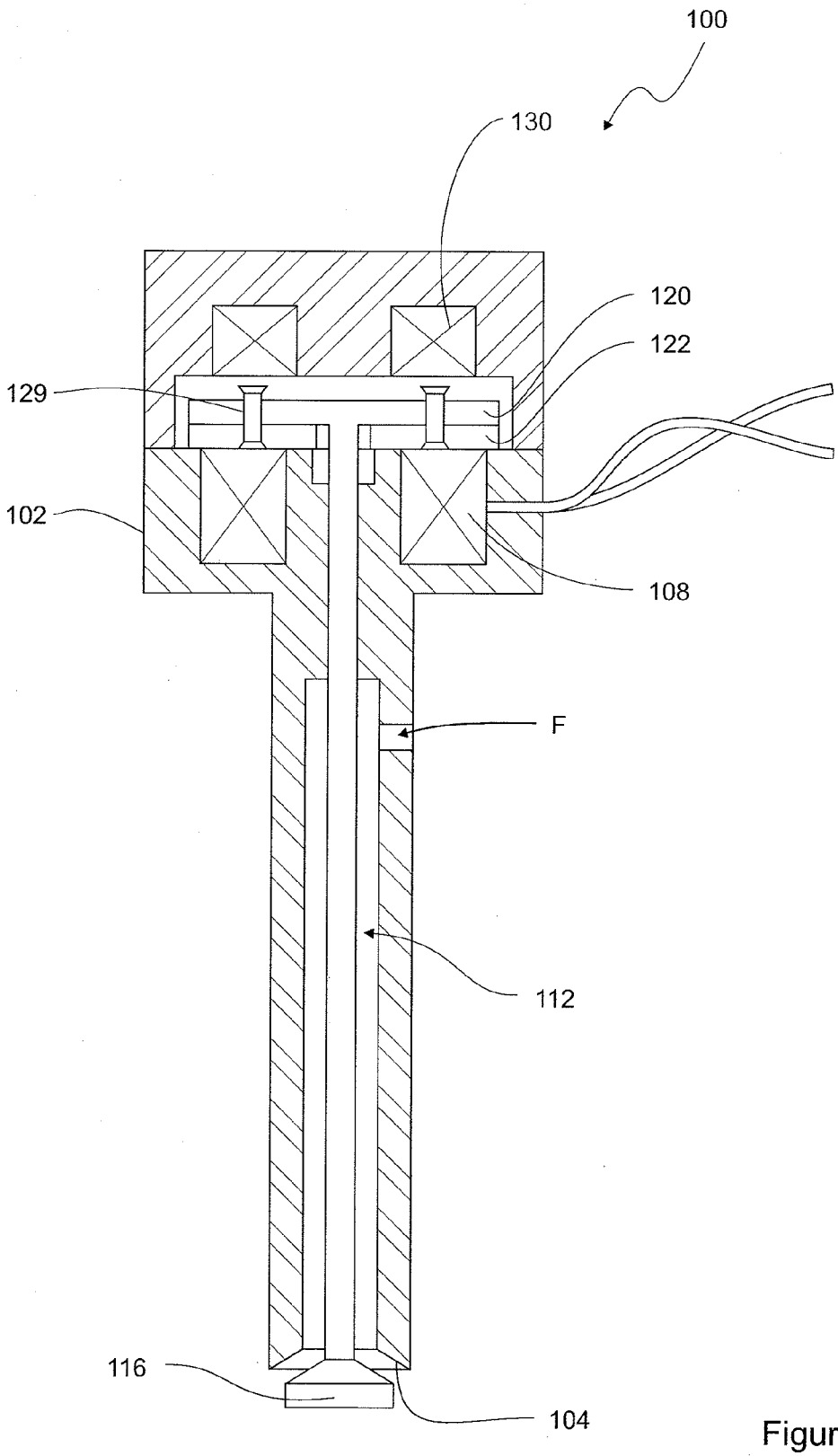
FIG. 4 is a schematic partial cross-sectional side view of the injector shown in FIG. 1 during valve actuation with the valve fully opened.

With further reference to FIGS. 2-4, the operation of the kinetic energy transfer armature is described. As shown in FIG. 2, when solenoid 108 is energized, the impact member 122 is pulled away from armature 120 against the closing force of return magnet 130. Impact member 122 includes a plurality of bearing holes 128 which correspond with each of the fasteners 124. Thus, impact member 122 slides in a longitudinal direction along fasteners 124 until they reach the end of travel allowed by fasteners 124. Fasteners 124 include an end stop, such as a rivet head, against which the impact member 122 stops. Impact member 122 also includes a central aperture 126 which provides clearance for valve stem 114. As impact member 122 is accelerated towards solenoid 108 it is imparted with kinetic energy which is then transferred to armature 120 once it reaches the end stops of fasteners 124.

As shown in FIG. 3, once the impact member 122 reaches end stops of fasteners 124 the kinetic energy in the impact member 122 is transferred to armature 120 which has pulled away from return magnet 130. As impact member 122 and armature 120 travel together towards solenoid 108 the impact member 122 stops against solenoid 108 and valve body 102, as shown in FIG. 3. It should be appreciated that solenoid 108 acts on both impact member 122 and armature 120 to actuate the valve 112. The solenoid 108 sequentially moves the impact member 122 and armature 120 toward the solenoid thereby actuating the valve. Thus, the transfer of kinetic energy from the impact member 122 to the armature 120 provides a slide hammer effect. At this point in the actuation cycle, the armature 120, and thus, the valve head 116, is at approximately half way through the valve's travel. Accordingly, valve head 116 has moved away from seat 104 as shown.

FIG. 4 illustrates injector 100 in the completely open position wherein armature 120 is pulled against impact member 122 and both of which are pulled against solenoid 108 and valve body 102. Armature 120 includes a plurality of bearing holes 129 each of which correspond to a fastener 124. Thus, as armature 120 reaches the end of its travel, the armature moves linearly relative to the fasteners 124. Valve head 116 is at its furthest extent away from valve seat 104 and thus fuel injector 100 is at its maximum open position.

Although injector 100 is shown in this embodiment as an outwardly opening valve, one of ordinary skill in the art will appreciate that the kinetic energy transfer armature arrangement disclosed herein is suitable for inward opening valves as well. For example, the solenoid 108, return magnet 130, and impact member 122 could be reversed relative to armature 120. Furthermore, even though the embodiments herein are described with respect to fuel injectors, actuators using the kinetic energy transfer armature technology described herein may also be used in conjunction with solenoid valves or as actuators for other purposes.

This kinetic energy production and transfer system provides numerous advantages. Multiple partial valve opening operations including valve reciprocation between open and closed extents are enabled by adaptive timing of the force and magnitude of the force that is applied by solenoid 108 to provide a wide variation of fuel flow rates and fuel entry patterns beyond valve seat 104. Such operations include operation at resonant frequencies of one or more selected components and/or the valve assembly for extremely rapid functions and/or energy conservation modes.

Figure 5:
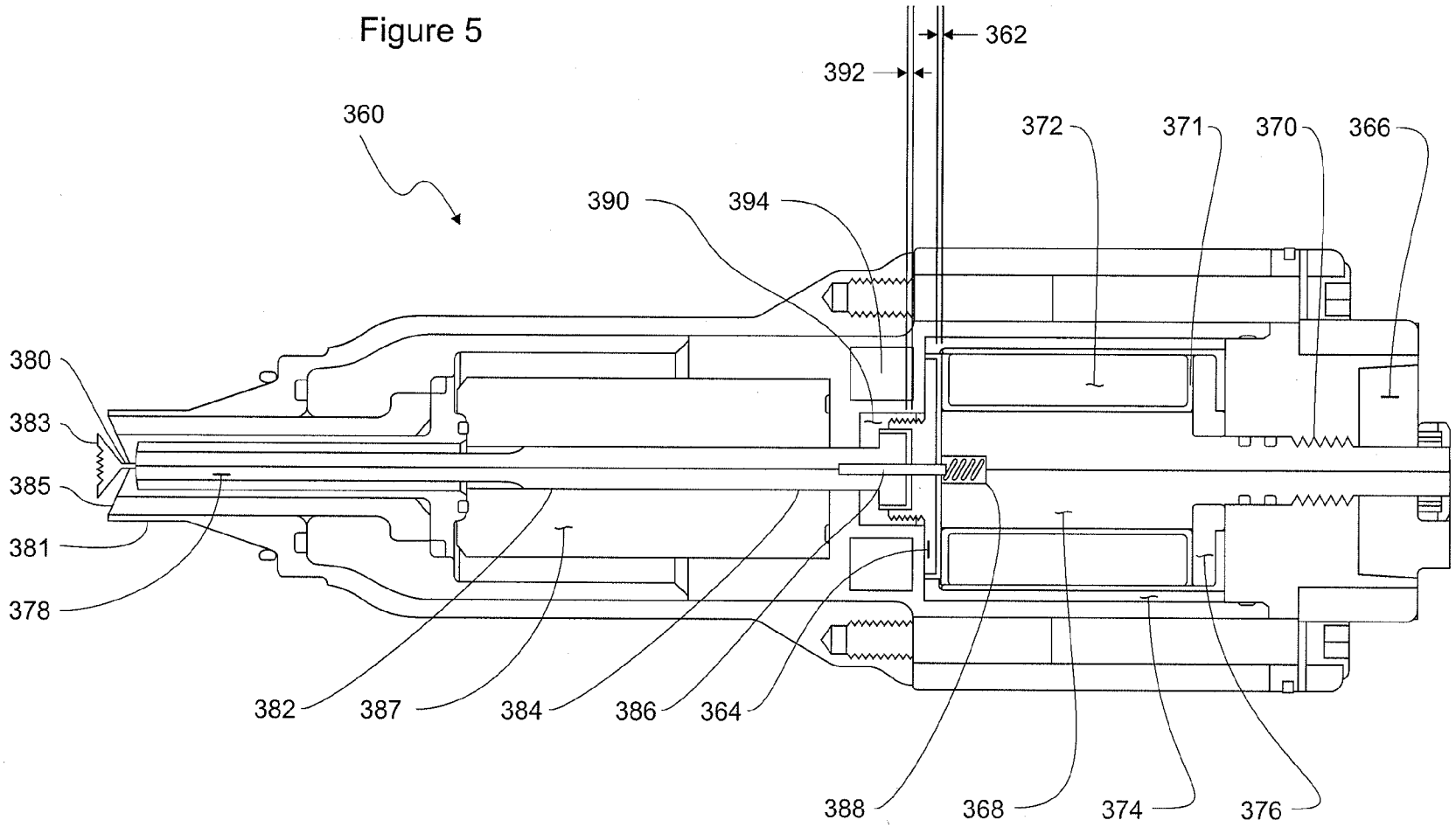
FIG. 5 is a schematic partial cross-sectional side view of an injector according to another representative embodiment incorporating a kinetic energy transfer armature.

FIG. 5 shows another embodiment of a fuel injector 360 that includes a control valve actuator system capable of rapid development of kinetic energy that is transferred to valve 378. The disclosed actuator system enables high frequency valve opening and closing cycles, including "flutter" operation, to controllably produce a wide spectrum of fuel projection angles and/or extremely high surface to volume fuel bursts. The overall axial stroke 362 of armature or disk driver 364 is adjusted by any suitable method including manual application of torque by a hex key or wrench or a suitable motor 366. Disk driver 364 may be a disk with a threaded portion to which cap 390 is attached and/or it may have another cylindrical feature that extends into the bore of bobbin 371 to define gap 362 at another desired location within the bore of bobbin 371. Motor 366 may include suitable gears or another speed reduction method to produce satisfactory torque and cause rotation of pole piece 368 and thus axial advancement or retraction according to the final rotational speed and pitch of threaded stem section 370 as shown.

Magnet winding 372 may be of any suitable design including one or multiple parallel coil circuits of magnet wire including single or multifilar types to produce the desired magnetic force and flux density in soft iron alloy pole piece 368 and in the face of disk driver 364 that is most proximate to winding 372 and pole piece 368. The bobbin 371 and/or the pole piece 368 may be or incorporate special function materials such as ferrite material to enable higher frequency operation. The primary winding may serve as the core of one or more subsequent windings including an autotransformer connection to minimize leakage inductance of the primary winding. Dielectric films such as polyimide may be used between successive winding layers to prevent short circuits. The winding may be impregnated with a dielectric potting compound and/or include a phase-change substance such as paraffin, sodium sulfate, or another suitable substance selection to prevent hot spots in the assembly. Such parallel windings effectively provide a line output or flyback transformer and can produce 20 to 50 kV at frequencies of 10 kHz to 60 kHz or higher.

A controller (not shown) initially provides a high current in windings 372 to accelerate the armature or disk driver 364, which may be a ferromagnetic or permanent magnet material, and develops sufficient kinetic energy that is transferred through a stop such as cap 390 to rapidly open valve 378. An alternative construction of disk driver 364 is the combination of a permanent magnet with a ferromagnetic material. For example, disk driver 364 may be a permanent magnet that is brazed or otherwise fastened to a ferromagnetic core. After valve 378 starts to open, the magnetic energy required to keep it open greatly diminishes and can be supplied by high frequency pulse width modulation which provides flyback transformer voltage and frequency which may be used to produce Lorentz plasma thrusting of oxidant and/or fuel particles into the combustion chamber along with other applications including energization of electromagnet 394 to accelerate the closure of disk driver 364 and thus valve 378.

Efficient containment of the magnetic flux is provided by selections of ferrites and/or other soft magnetic materials for field strength flux shaping by formed cup or sleeve 374, stationary disk 376, cylindrical pole piece 368, and movable flux collection and disk driver 364. The geometry, diameter and effective flux path thickness of disk driver 364 is optimized with respect to factors such as fuel pressure, combustion chamber geometry, fuel penetration and combustion pattern, and oxidant utilization efficiency for maximizing the magnetic force and producing the kinetic energy desired for rapid opening of valve 378 as disk driver 364 moves freely through distance 392 allowed by cap 390 until valve 378 is engaged to be rapidly opened to the remaining adjustable allowance 362 as shown.

Disk driver 364 thus becomes a kinetic energy production, storage, and application device for opening valve 378 along with the magnetic flux path for various additional purposes including opening valve 378, generation of ignition energy, and/or closure of valve 378 in response to magnetic force from annular permanent or electromagnet 394. Therefore the major outside diameter of disk driver 364 may range from about the diameter of pole piece 368 to the diameter of disk 376 and accordingly the thickness may vary as needed to be an efficient pathway for magnetic flux and production of desired kinetic energy particularly during acceleration in stroke portion 392. Accordingly, the geometry and dimensions of flux cup 374 follow the dimensions of disk driver 364 to provide the most efficient flux path.

Valve 378 is guided along the centerline of orifice 380 by suitable axial motion bearing zones such as 382 and 384 in ceramic insulator 387. This provides driver disk 364 with low-friction centerline guidance along stem 386. Compression spring 388 and/or an electromagnet or permanent magnet in annular zone 394 provide rapid return of disk driver 364 along with cap 390 and valve 378 to the normally closed position to seal valve 378 against orifice 380 as shown.

Conical electrode 385 extends inward from cylindrical electrode 381 to form an expanding annular gap with electrode 383. A wide array of fuel injection and/or plasma spray patterns may be produced by varying opening distances of 392 and/or 362 of valve 378, along with the frequency and current density of plasma generation in the gap between 383 and 385.

In embodiments that use an electromagnet or combination of a permanent magnet and an electromagnet in zone 394 the "flyback energy" discharged by inductor winding 372 may be used directly or through a capacitor to optimize the timing of closure force application and thus quickly develop current in the electromagnet 394 to produce magnetic force to attract and rapidly close disk driver 364. Similarly, high voltage may be applied as direct current, pulsed current or alternating current at high frequencies to create successive Lorentz acceleration of ion or plasmas that are launched into the combustion chamber by electrodes sets such as 383, 385.

Figure 6:
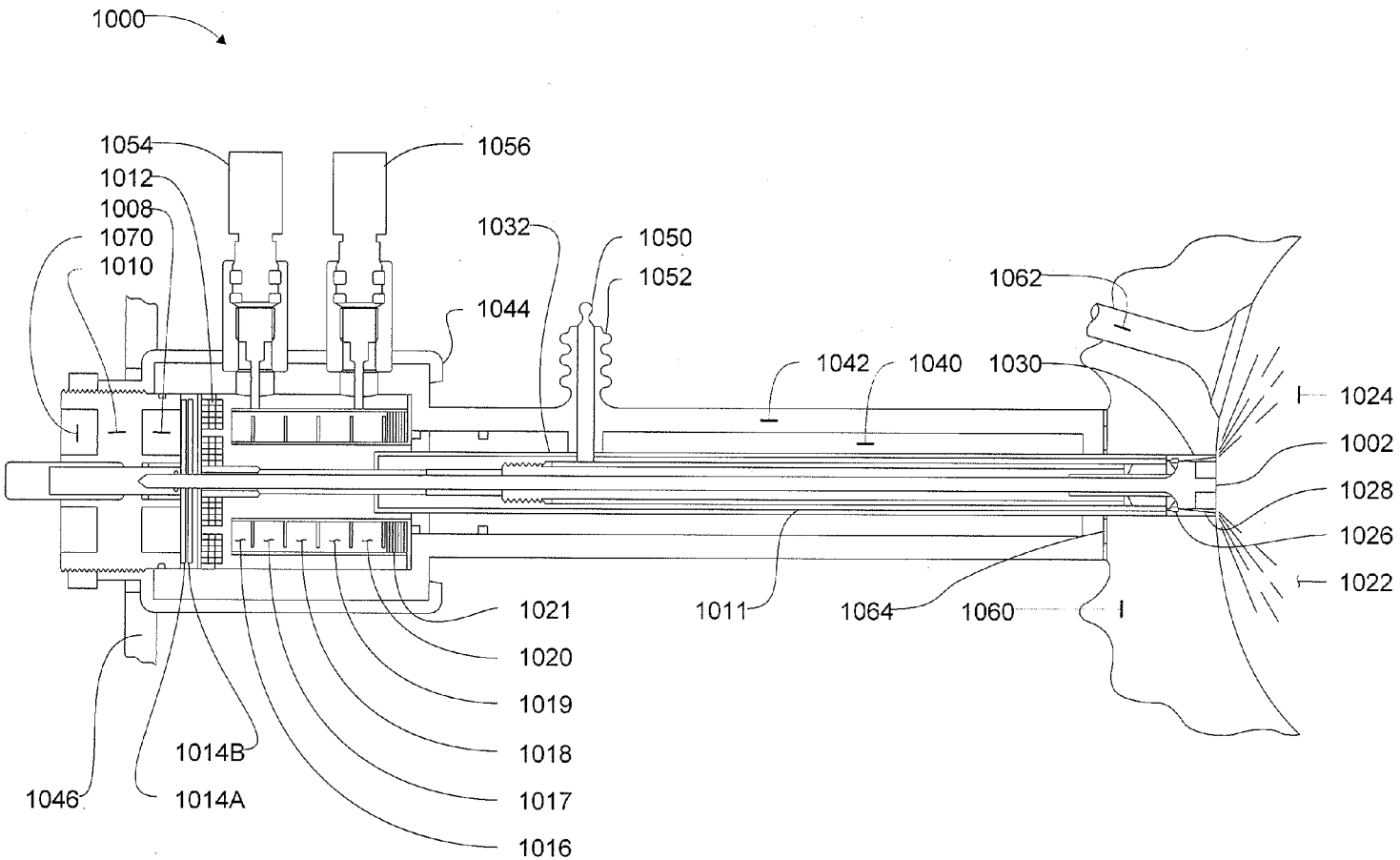
FIG. 6 is a schematic partial cross-sectional side view of an injector according to a further representative embodiment incorporating a kinetic energy transfer armature.

FIG. 6 shows an injector system 1000 according to a further representative embodiment. Injector system 1000 includes an assembly of components useful for converting heat engines, e.g., such as piston engines, to operation on alternative fuels, such as gaseous fuels. A representative illustration of such engines includes a partial section of a portion of combustion chamber 1024 including engine head portion 1060, an inlet or exhaust valve 1062 (e.g., generally typical to two or four valve engine types), a glass body 1042, adapter encasement 1044 and a section of an engine hold down clamp 1046 for assembling the system 1000 in a suitable port through the casting of engine head portion 1060 to the combustion chamber 1024. A suitable gasket, O-ring assembly, and/or or washer 1064 may be utilized to assure establishment of a suitable seal against gas travel out of the combustion chamber 1024.

Glass body 1042 may be manufactured from a suitable material selection to include development of compressive surface forces and stress particularly in the outside surfaces to provide long life with adequate resistance to fatigue and corrosive degradation. Contained within the glass body 1042 are additional components of the system 1000 for providing combined functions of fuel injection and ignition by one or more technologies. For example, actuation of fuel control valve 1002, which operates by axial motion within the central bore of an electrode 1028 for the purpose of opening outward and closing inward, may be by a suitable piezoelectric, magnetostrictive, or solenoid assembly.

For the purpose of illustration, an electromagnetic-magnetic actuator assembly is shown as an electromagnet 1012, one or more ferromagnetic armature disks 1014A and 1014B, and electromagnet and/or permanent magnet 1008. Multiple component armatures and/or devices such as travel limiting caps or other kinetic energy transfer stops of the types described regarding embodiments 100, 360, or 1000 may be selected. Illustratively, armature disks 1014A and 1014B provide a slide hammer effect that quickly opens the valve similar to that described above with respect to FIGS. 1-4. For example, in operation, after magnetic attraction reaches saturation of disk 1014A, disk 1014B is then closed against disk 1014A. Disk 1014A is attached to disk 1014B by one or more suitable stops such as riveted bearings that allow suitable axial travel of disk 1014B from 1014A to a preset kinetic drive motion limit. In the normally closed position of valve 1002, disk 1014A is urged toward magnet 1008 to thus exert closing force on valve 1002 through a suitable head on the valve stem of valve 1002 as shown, and disk 1014B is closed against the face of disk 1014A. Establishing a current in one or more windings of electromagnet 1012 produces force to attract and produce kinetic energy in disk 1014B which then suddenly reaches the limit of free axial travel to quickly pull disk 1014A along with valve 1002 to the open position and allow fuel to flow through radial ports near electrode tips 1026.

Figure 7:
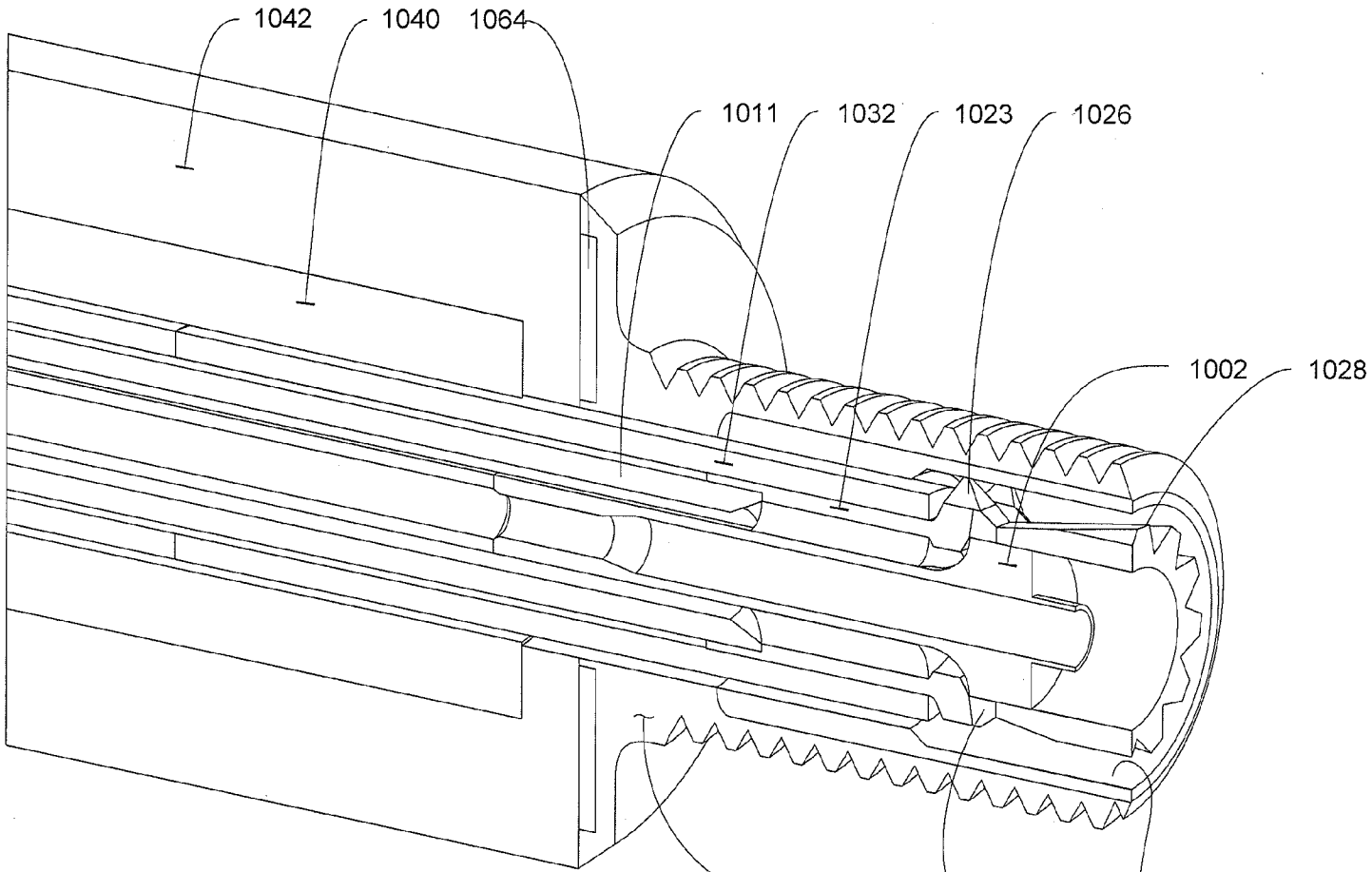
FIG. 7 is an enlarged partial cross-sectional perspective view of the injector shown in FIG. 6.

FIG. 7 shows an enlarged view of an embodiment with selections of the valve and support assembly components of the system 1000 that are near the combustion chamber including outward opening fuel control valve 1002, valve seat and electrode component 1023 including electrode tips such as 1026 and various swirl or straight electrodes such as 1028. A valve opening monitor or sensor (not shown) may be disposed on valve 1002 that enables adaptively controlled (e.g., closed-loop) valve displacement by voltage adjustments to overcome and correct valve opening/closing errors due to elastic or thermal expansion variations and/or mismatch.

Also shown in FIG. 7 is an exemplary embodiment of an engine adapter 1025 that is threaded into a suitable port to provide secure support for the seal 1064 and to serve as a replaceable electrode 1030. During the normally closed time that fuel flow is prevented by valve 1002, ionization of an oxidant (e.g., such as air) may occur according to process instructions provided from controller 1070. During intake and/or compression events in combustion chamber 1024, air admitted into the annular space between electrodes 1026/1028 and electrode 1030 is ionized to form an initial current between electrode tips 1026 and electrode 1030. This greatly reduces the impedance, and much larger current can be efficiently produced along with Lorentz force to accelerate the growing population of ions that are thrust into combustion chamber 1024 in controllable penetration patterns 1022.

Similarly, at times that valve 1002 is opened to allow fuel to flow through ports 1029 into the annular space between electrodes 1026/1028 and electrode 1030, fuel particles are ionized to form an initial current between electrode tips 1026 and 1030. This greatly reduces the impedance, and much larger current can be controllably produced along with greater Lorentz force to accelerate the growing population of ions that are thrust into combustion chamber 1024. Such ions and other particles are initially swept at sub-sonic or at most sonic velocity, e.g., because of the choked flow limitation past valve 1002. However Lorentz force acceleration along electrodes 1030 and 1028 can be controlled to rapidly accelerate the flow to sonic or supersonic velocities to overtake slower populations of previously accelerated oxidant ions in combustion chamber 1024.

High voltage for such ionization and Lorentz acceleration events may be generated by annular transformer windings in cells 1016, 1017, 1018, 1019, 1020, etc., starting with current generation by pulsing of inductive coils 1012 prior to application of increased current to open armatures 1014A and 1014B and valve 1002. One or more capacitors 1021 may store the energy produced during such transforming steps for rapid production of initial and/or thrusting current levels in ion populations between electrodes 1026/1028 and 1030.

In some embodiments, corona discharge may be produced by a high rate of field development delivered through conductor 1050 or by very rapid application of voltage produced by the transformer (e.g., via annular transformer windings in cells 1016 1017, 1018, 1019, 1020, etc.), and stored in capacitor 1040 to present an electric field to cause additional ionization within combustion chamber 1024 including ionization and/or radiation at fuel ignition frequencies including ultraviolet frequencies in the paths established by ions thrust into patterns by Lorentz acceleration.

High dielectric strength insulator tube 1032 may extend to the zone within capacitors 1021 to contain high voltage that is delivered by a conductive tube 1011 including electrode tips 1026 and tubular portion 1028 as shown. Thus, the dielectric strength of the glass case 1042 and the insulator tube 1032 provides compact containment of high voltage accumulated by the capacitor 1040 for efficient discharge to produce corona events in combustion chamber 1024. In other words, the glass case 1042 facilitates higher capacitance energy and the glass becomes a functional element in the capacitor that allows the capacitor to build charge slowly and then discharge very rapidly (e.g. corona burst). In some implementations, selected portions of glass tube 1042 may be coated with a conductive layer of aluminum, copper, graphite, stainless steel or another RF containment material or configuration including woven filaments of such materials.

In some embodiments, the system 1000 includes a transition from the dielectric glass case 1042 to a steel or stainless steel jacket 1044 that allows application of the engine clamp 1046 to hold the assembly 1000 closed against the gasket seal 1064. For example, the jacket 1044 can include internal threads to hold externally threaded cap assembly 1010 in place as shown.

System 1000 may be operated on low voltage electricity that is delivered by cable 1054 and/or cable 1056, e.g., in which such low voltage is used to produce higher voltage as required including actuation of piezoelectric, magnetostrictive or electromagnet assemblies to open valve 1002 and to produce Lorentz and/or corona ignition events as previously described. Alternatively, for example, the system 1000 may be operated by a combination of electric energy conversion systems including one or more high voltage sources (not shown) that utilize one or more posts such as the conductor 1050 insulated by a glass or ceramic portion 1052 to deliver the required voltage and application profiles to provide Lorentz thrusting and/or corona discharge.

This enables utilization of Lorentz-force thrusting voltage application profiles to initially produce an ion current followed by rapid current growth along with one or more other power supplies to utilize RF, variable frequency AC or rapidly pulsed DC to stimulate corona discharge in the pattern of oxidant ion and radical and/or swept oxidant injection into combustion chamber 1024, as well as in the pattern of fuel ions and radicals and/or swept fuel particles that are injected into combustion chamber 1024. Accordingly, the energy conversion efficiencies for Lorentz and/or for corona ignition and combustion acceleration events are improved.

Also contemplated herein are methods of actuating a valve using a kinetic energy transfer armature. The methods may include any procedural step inherent in the structures described herein. In an embodiment, the method may comprise holding the valve in a closed position, accelerating an impact member relative to an armature connected to the valve, thereby imparting kinetic energy to the impact member, and transferring at least a portion of the kinetic energy from the impact member to the armature, thereby causing the valve to move to an open position. In some embodiments, holding the valve in the closed position is accomplished with a magnet. In other embodiments accelerating the impact member relative to the armature is accomplished with a solenoid, wherein the solenoid is operative when energized to sequentially move the impact member and armature toward the solenoid, thereby actuating the valve.

Illustratively, extremely high frequency flutter operation of a fluid control valve can provide many operations including pressure regulation, atomization of liquid fluids such as fuels to fog droplets, or phase changes and/or operation in selected reciprocation extents to provide widely varying patterns of fluid flow beyond the control valve 825. Such operations are especially beneficial for air-conditioning humidification, clog prevention applications of food seasoning such as evaporative salting of selected surfaces, and for direct injection of fuel into furnaces or engines.

Figure 8:
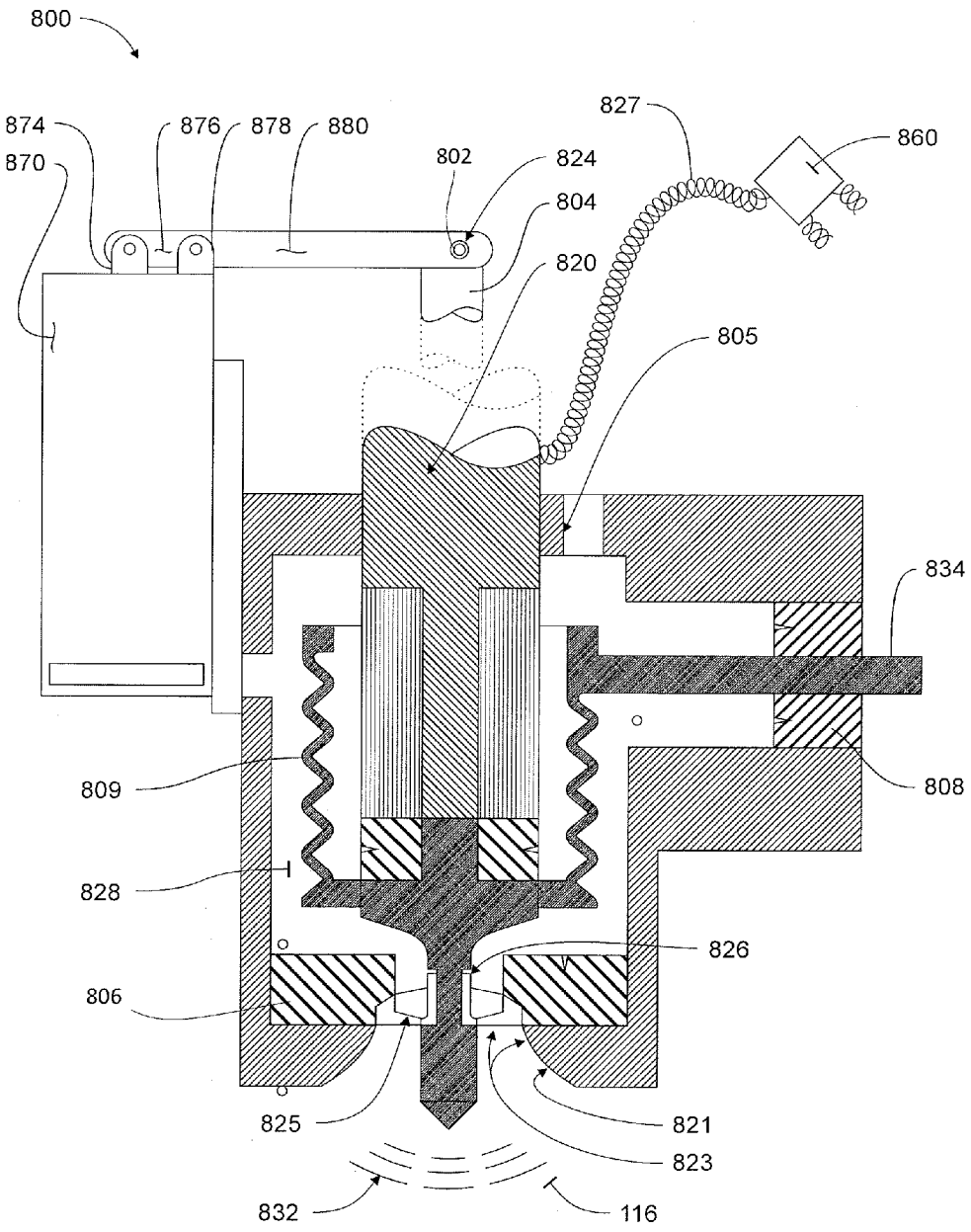
FIG. 8 is a schematic partial cross-sectional side view of an injector according to another representative embodiment.

Embodiment 800 of FIG. 8 shows piezoelectric actuator 870 that provides high forces through relatively short push-pull stroke through output linkage 874 for motion through rotation linkage portion 876 which is amplified by the greater portion of rocker arm 880 from fulcrum bearing 878 as shown. Pin 802 is tapered and is able to provide a controlled variation of the stroke of linkage 804 by movement of pin 802 into and out of the similarly tapered bearing bore 824 and thus vary from near net fit to the desired magnitude of free motion of arm 880 before transmitting the kinetic energy in the assembly through linkage 804 to assembly 820 including motion of fluid control valve 825 from the valve seat in component 806 as shown. Valve 825 may further utilize the kinetic energy gained in assembly 820 to provide quick opening, closing and/or resonant flutter motion as a result of the elastic modulus and spring constant of elastomeric disk 826 such as may be made from urethane or a suitable fluoropolymer or silicone material.

In certain instances embodiment 800 also provides isolation by insulator components 806 and 808 of suitably high voltage applied through conductor 834 to contactor, spring or bellows 809 for generation of spark, Lorentz thrust and/or corona ignition of fuel fluids by initial ionization of fluid in gap 823 multiplication of the ion population from fluid bursts in expansion nozzle 821 and/or by corona discharge in space 832 of a furnace or combustion chamber 816. Adaptive control of such operations by controller 860 may utilize information such as temperature, pressure, and fluid distribution along with combustion pattern detection as may be produced and/or transmitted by fiber optics 827 and/or wireless information relay as shown. Pressurized fluid that enters embodiment 800 through port 805 can thus be provided with pressure regulation, and/or spray pattern control and/or production of fog like sprays or phase change along with one or more types of ionization and/or ignition by the operations described.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. The following examples provide additional embodiments of the present technology.

EXAMPLES

1. A fuel injector, comprising:

a longitudinally extending injector body;

a valve supported in the injector body and configured for longitudinal movement therein;

an armature connected to the valve;

a solenoid;

an impact member disposed between the armature and solenoid, and moveably connected to the armature;

wherein the solenoid is operative when energized to sequentially move the impact member and armature toward the solenoid, thereby actuating the valve.

2. The fuel injector of example 1, wherein the armature is a disk.

3. The fuel injector of example 2, wherein the impact member is a disk.

4. The fuel injector of example 3, wherein the impact member and armature are connected together by a plurality of fasteners.

5. The fuel injector of example 4, wherein the plurality of fasteners includes rivets.

6. The fuel injector of example 1, wherein the valve opens outward from the injector body.

7. The fuel injector of example 1, further comprising a return magnet located adjacent the armature and opposite the solenoid, wherein the return magnet is operative to maintain the valve in a closed position when the solenoid is not energized.

8. The fuel injector of example 7, wherein the return magnet is an electromagnet.

9. A solenoid valve, comprising:

a valve body;

a valve supported in the valve body and configured for linear movement therein;

an armature connected to the valve;

a solenoid;

an impact member disposed between the armature and solenoid, and moveably connected to the armature;

wherein the solenoid is operative when energized to sequentially move the impact member and armature toward the solenoid, thereby actuating the valve.

10. The solenoid valve of example 9, wherein the armature is a disk.

11. The solenoid valve of example 10, wherein the impact member is a disk.

12. The solenoid valve of example 9, wherein the impact member and armature are connected together by a plurality of fasteners.

13. The solenoid valve of example 12, wherein the plurality of fasteners includes rivets.

14. The solenoid valve of example 9, wherein the valve opens outward from the valve body.

15. The solenoid valve of example 9, further comprising a return magnet located adjacent the armature and opposite the solenoid, wherein the return magnet is operative to maintain the valve in a closed position when the solenoid is not energized.

16. The solenoid valve of example 15, wherein the return magnet is an electromagnet.

17. A method of actuating a valve, comprising:

holding the valve in a closed position;

accelerating an impact member relative to an armature connected to the valve, thereby imparting kinetic energy to the impact member; and transferring at least a portion of the kinetic energy from the impact member to the armature, thereby causing the valve to move to an open position.

18. The method of example 17, wherein holding the valve in the closed position is accomplished with a magnet.

19. The method of example 17, wherein accelerating the impact member relative to the armature is accomplished with a solenoid.

20. The method of example 19, wherein the solenoid is operative when energized to sequentially move the impact member and armature toward the solenoid, thereby actuating the valve.

I claim:

1. A fuel injector, comprising:

a longitudinally extending injector body;

a valve supported in the injector body and configured for longitudinal movement therein;

an armature connected to the valve;

a solenoid;

an impact member disposed between the armature and solenoid, and moveably connected to the armature;

wherein the solenoid is operative when energized to sequentially move the impact member and armature toward the solenoid, thereby actuating the valve.

2. The fuel injector of claim 1, wherein the armature is a disk.

3. The fuel injector of claim 2, wherein the impact member is a disk.

4. The fuel injector of claim 3, wherein the impact member and armature are connected together by a plurality of fasteners.

5. The fuel injector of claim 4, wherein the plurality of fasteners includes rivets.

6. The fuel injector of claim 1, wherein the valve opens outward from the injector body.

7. The fuel injector of claim 1, further comprising a return magnet located adjacent the armature and opposite the solenoid, wherein the return magnet is operative to maintain the valve in a closed position when the solenoid is not energized.

8. The fuel injector of claim 7, wherein the return magnet is an electromagnet.

9. A solenoid valve, comprising:

a valve body;

a valve supported in the valve body and configured for linear movement therein;

an armature connected to the valve;

a solenoid;

an impact member disposed between the armature and solenoid, and moveably connected to the armature;

wherein the solenoid is operative when energized to sequentially move the impact member and armature toward the solenoid, thereby actuating the valve.

10. The solenoid valve of claim 9, wherein the armature is a disk.

11. The solenoid valve of claim 10, wherein the impact member is a disk.

12. The solenoid valve of claim 9, wherein the impact member and armature are connected together by a plurality of fasteners.

13. The solenoid valve of claim 12, wherein the plurality of fasteners includes rivets.

14. The solenoid valve of claim 9, wherein the valve opens outward from the valve body.

15. The solenoid valve of claim 9, further comprising a return magnet located adjacent the armature and opposite the solenoid, wherein the return magnet is operative to maintain the valve in a closed position when the solenoid is not energized.

16. The solenoid valve of claim 15, wherein the return magnet is an electromagnet.

17. A method of actuating a valve, comprising:

holding the valve in a closed position;

accelerating an impact member relative to an armature connected to the valve, thereby imparting kinetic energy to the impact member; and transferring at least a portion of the kinetic energy from the impact member to the armature, thereby causing the valve to move to an open position, wherein the impact member and armature are sequentially accelerated to actuate the valve.

18. The method of claim 17, wherein holding the valve in the closed position is accomplished with a magnet.

19. The method of claim 17, wherein accelerating the impact member relative to the armature is accomplished with a solenoid.

20. The method of claim 19, wherein the solenoid is operative when energized to sequentially move the impact member and armature toward the solenoid, thereby actuating the valve.

* * * * *